US007086186B2

(12) United States Patent
Kobayashi et al.

(10) Patent No.: US 7,086,186 B2
(45) Date of Patent: Aug. 8, 2006

(54) IRONING DEVICE

(75) Inventors: Shinichiro Kobayashi, Osaka (JP); Mamoru Ikeshima, Hyogo (JP); Yoshinori Kataoka, Osaka (JP); Toshihide Nakamura, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 40 days.

(21) Appl. No.: 10/893,971

(22) Filed: Jul. 20, 2004

(65) Prior Publication Data

US 2005/0016035 A1 Jan. 27, 2005

(30) Foreign Application Priority Data

Jul. 22, 2003 (JP) ..... 2003-277390
Jul. 22, 2003 (JP) ..... 2003-277393
Aug. 5, 2003 (JP) ..... 2003-286664

(51) Int. Cl.
*D06F 75/40* (2006.01)

(52) U.S. Cl. ..... 38/96

(58) Field of Classification Search ..... 38/88, 38/79, 96, 107, 77.6; D32/72, 73
See application file for complete search history.

(56) References Cited

U.S. PATENT DOCUMENTS 1,549,954 A * 8/1925 Ball ..... 38/96
5,315,773 A * 5/1994 Iwami et al. ..... 38/77.6

FOREIGN PATENT DOCUMENTS

JP 404005995 A * 1/1992
JP 404354990 A * 12/1992
JP 06-023200 A * 1/1994
JP 406178898 A * 6/1994
JP 2003-038899 2/2003

* cited by examiner

*Primary Examiner*—Ismael Izaguirre
(74) *Attorney, Agent, or Firm*—McDermott Will & Emery LLP

(57) ABSTRACT

Near the middle portion as viewed from side of cover case, there is provided a case space through cover case, thereby forming cover case grip portion in cover case. Near the middle portion as viewed from side of the iron body, there is provided a body space there through, thereby forming iron grip portion in iron body. And, it is configured in that cover case grip portion and iron grip portion can be gripped together when iron body is being placed on stand.

17 Claims, 6 Drawing Sheets

IRONING DEVICE

FIELD OF THE INVENTION

The present invention relates to an ironing device comprising an iron body for ironing out wrinkles on clothes and the like, and a stand with a mount for placing the iron body thereon.

BACKGROUND OF THE INVENTION

A conventional ironing device mentioned in Japanese Laid-open Patent 2003-38899 is described with reference to FIG. 7. The conventional ironing device comprises iron body 41 with base 40 heated by a heater, mount 42 for placing iron body 41 thereon, cover case 43 for covering iron body 41 placed on mount 42, and coupling means 44 for detachably coupling cover case 43 to mount 42. Operation section 45 such as steam buttons is arranged at top of the iron body. Bottom 46 of cover case 43 is plane, and grip portion 47 is formed at top of cover case 43.

However, in the conventional configuration described above, care must be taken when placing iron body 41 on mount 42 and putting on cover case 43 from above.

That is, after finishing the ironing work, the power plug is pulled out from the power outlet, and cover case 43 is put on mount 42.

And, the ironing device is carried to keep it in a cabinet or the like until the time of next use. At the time, mount 42 and iron body 41 hang on to cover case 43 via coupling means 44. If coupling means 44 should fail to work sufficiently, there will be a fear of falling of iron body 41 together with mount 42 while the ironing device is carried. In order to prevent this, it is necessary to make sure of sufficient coupling before carrying the ironing device.

Also, in the conventional example, grip portion 47 of cover case 43 is a member separate from iron body 41, and is structurally rotatable. When not carried, grip portion 47 is shifted down and buried in iron case 43. When carried, grip portion 47 is raised and gripped, requiring two steps of operation, and it worsens the using convenience.

Also, in the conventional structure, since grip portion 47 of cover case 43 is a member separate from iron case 43, parts for rotatable structure in addition to grip portion 47 are required, causing the cost to be increased.

SUMMARY OF THE INVENTION

The present invention is intended to solve the above conventional problem.

The ironing device of the present invention comprises an iron body with a base heated by a heater, a stand with a mount for placing the iron body thereon, and a cover case which can be coupled to the stand. The cover case is formed with a grip portion at top thereof. The grip portion is formed by providing a case space through the cover case.

DETAILED DESCRIPTION OF THE EXEMPLARY EMBODIMENT

Figure 1:
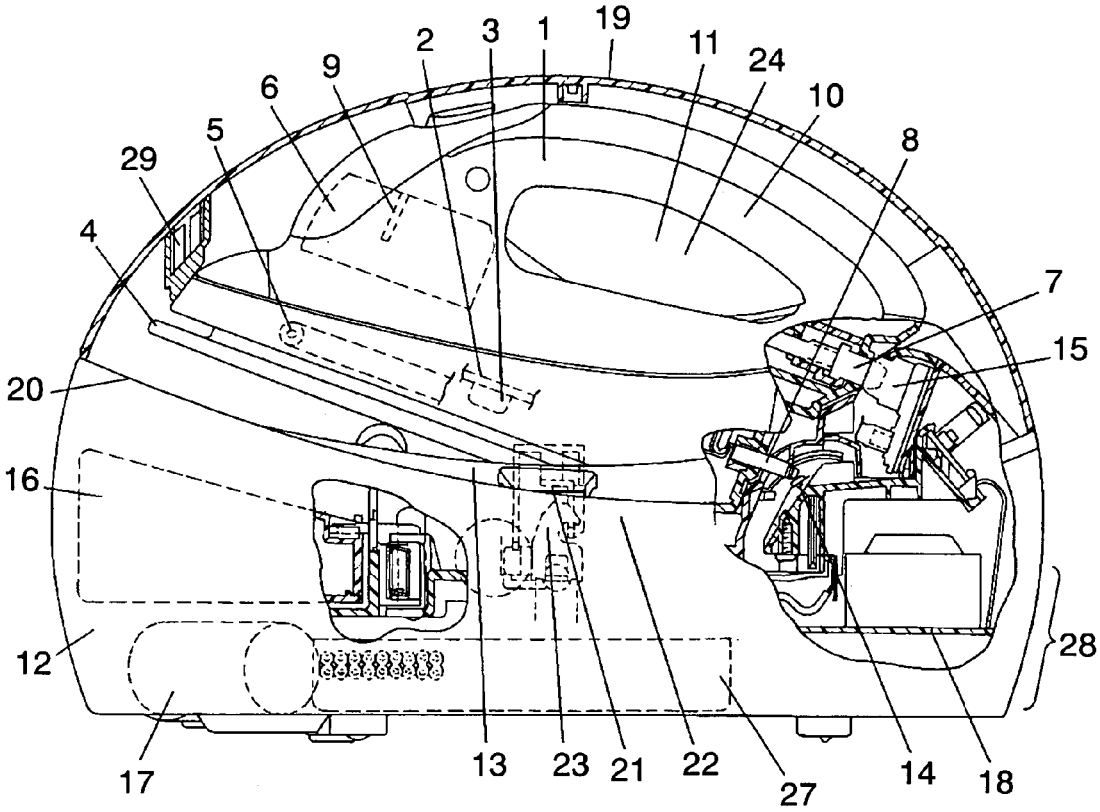
FIG. 1 is a sectional view of an essential portion of an ironing device in one preferred embodiment of the present invention.
Figure 2:
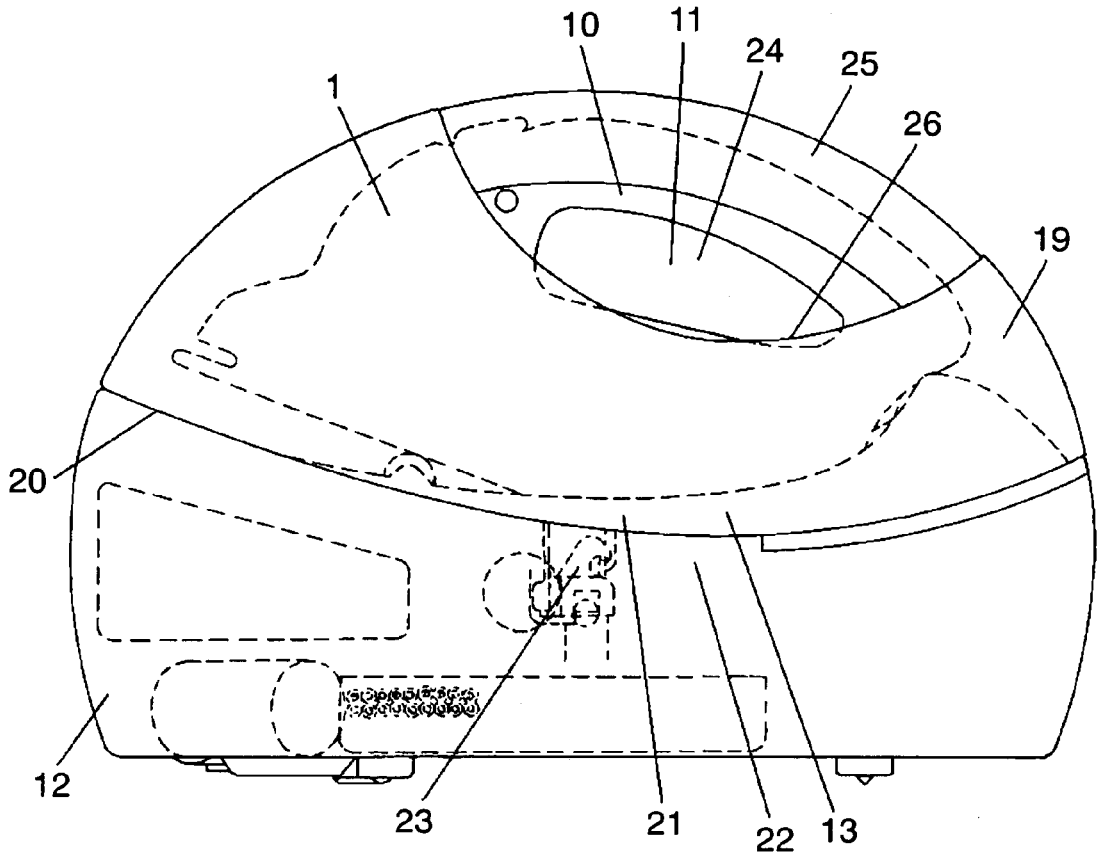
FIG. 2 is a side view of an ironing device in the preferred embodiment.

One preferred embodiment of the present invention will be described in the following with reference to FIG. 1 to 6.

Iron body 1 includes (i) base 4 forming vaporizing chamber 3 covered with cover 2, (ii) heater 5 for heating base 4, (iii) tank 6 communicating with vaporizing chamber 3 via a water channel (not shown), (iv) water inlet port 7 for feeding water to tank 6, (v) power receiving terminal 8 connected to heater 5, (vi) water level detector 9 for detecting the water level in tank 6, and (vii) iron grip portion 10 for the operator who holds iron body 1.

Below iron grip portion 10, there is provided body space 11 formed there through for easier gripping. Water inlet port 7 is provided above and beyond power receiving terminal 8 on an extension line in the lengthwise direction of iron grip portion 10.

Stand 12 includes (i) mount 13 for placing iron body 1 aslant thereon with the rear of base 4 down, (ii) a plurality of power feeding portions 14 each connected to power receiving terminal 8, (iii) water feed portion 15 disposed at a position opposite to water inlet port 7, that is, above and beyond power receiving terminal 8 and in the middle of the right and left of mount 13, and (iv) water tank 16 for storing water fed to tank 6 via water feed portion 15 and water inlet port 7.

Further, stand 12 includes water feeding unit 17 comprising a pump or the like for feeding the water stored in water tank 16 to tank 6 via water feed portion 15 and water inlet port 7, and controller 18 for controlling the power supply to heater 5 and the drive of water feeding unit 17.

Mount 13, slanted with the front up, is provided at top of stand 12. Water tank 16 is arranged below mount 13 and at the front of stand 12. Water feeding unit 17 is further positioned under water tank 16.

And, under water tank 16 is disposed power cord reel unit 27 at the back of water feeding unit 17.

Cover case 19 is fitted on stand 12, which covers iron body 1 from above with iron body 1 placed on mount 13. Cover case 19 and stand 12 configure a casing.

When cover case 19 is viewed from side, middle portion 21 of bottom 20 is arcuately extended downward from the front and rear ends. When stand 12 is viewed from side, middle portion 22 of the stand is recessed downward from the front and rear ends so as to go along the shape of bottom 20 of cover case 19. Also, coupling means 23 for coupling cover case 19 to stand 12 is disposed in a position near the lowest end of cover case 19.

The contour of cover case 19 is convex in shape formed by curved surfaces being smooth as a whole. And, nearly in the middle of cover case 19 as viewed from side is formed case space 24 formed there through, and case grip portion 25 is formed at top thereof. When cover case 19 is viewed from above, the middle thereof in the right and left direction is smoothly continuous with the entire contour, forming the upper side surface of the case grip portion, and the right and left sides of the upper side surface form a concave shape in the forward and backward direction (as viewed from side), and the upper surface is extended from the outer shell toward the middle, thereby forming the bottom of case space 24, covering portion 26 which covers the top of the iron body. That is, covering portion 26 is formed one-piece with cover case 19 under case grip portion 25 in order to cover the top of iron body 1. Also, a part of covering portion 26 is opened so that iron grip portion 10 may protrude upward.

When case grip portion 25 of cover case 19, with iron body 1 placed on mount 13 of stand 12, is fitted on stand 12, case space 24 of cover case 19 is opposed to body space 11 of iron body 1. Also, case grip portion 25 is positioned very close to iron grip portion 10 of iron body 1 so as to cover it from outside. That is, with iron body 1 positioned in place, iron grip portion 10 of iron body 1 and case grip portion 25 of cover case 19 can be gripped together.

Also, in cover case 19, when body 1 is placed on mount 13 of stand 12, there is provided holding member 29 which holds the tip portion of iron body 1 in such a state that cover case 19 is coupled to stand 12.

Figure 6:
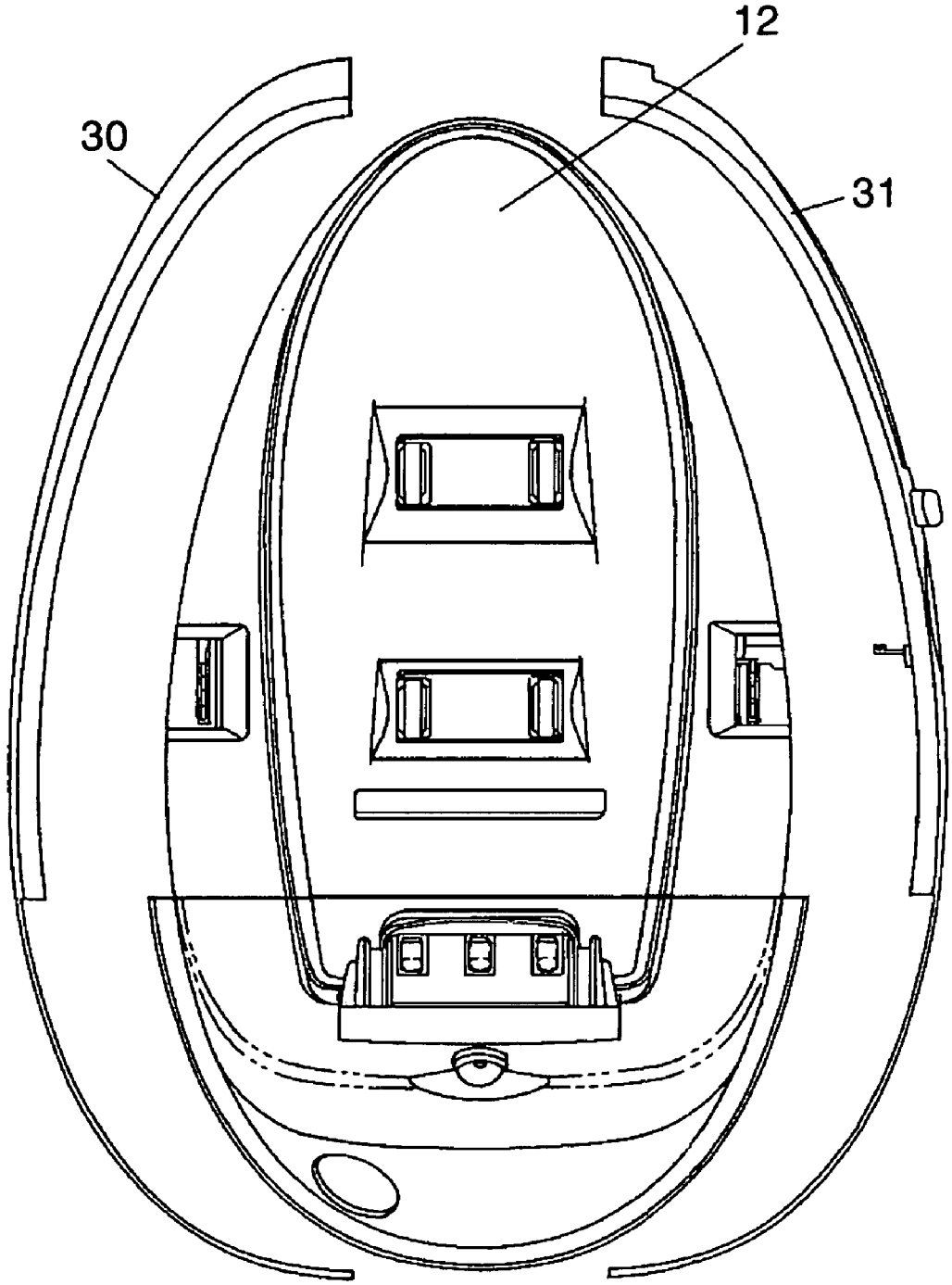
FIG. 6 is explanatory diagram of stand side of an ironing device in the preferred embodiment.
Figure 7:
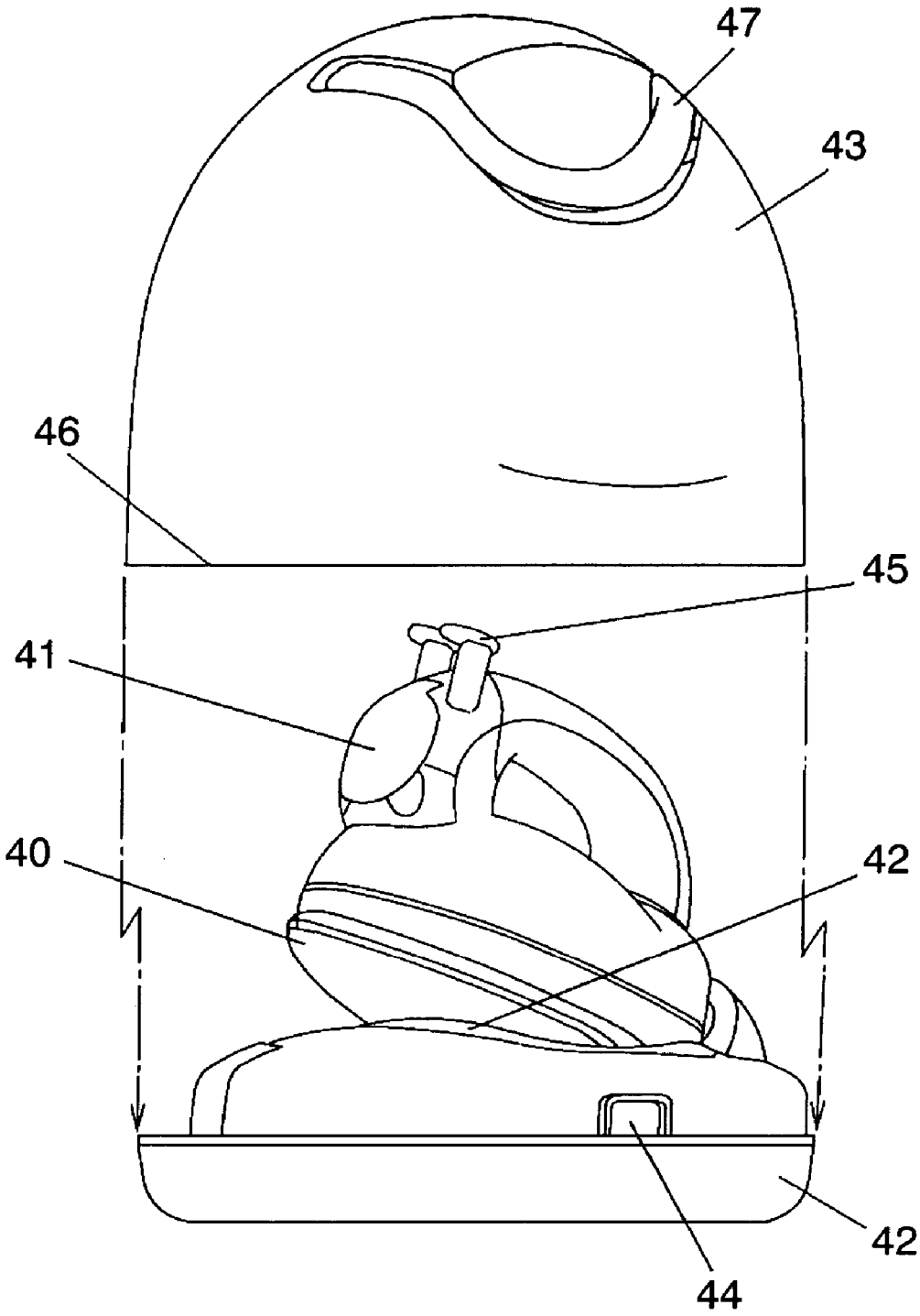
FIG. 7 is a perspective view of a conventional ironing device with cover case removed.

Further, as shown in FIG. 6, left-hand surface 30 and right-hand surface 31 of stand 12 are separated from each other in the configuration. Also, lower end entire periphery 28 of the outer shell of stand 12 is arcuately formed.

In the above configuration, the operation and action will be described in the following. First, when ironing, iron body 1 is placed on mount 13 of stand 12, and then the power is turned on. In this case, water inlet port 7 disposed in iron body 1 is connected to water feed portion 15 disposed in stand 12. And, tank 6 of iron body 1 and water tank 16 of stand 12 are communicated with each other. Also, power receiving terminal 8 disposed in iron body 1 is connected to power feeding portion 14 disposed in stand 12.

And, water feeding unit 17 is driven by controller 18, and the water in water tank 16 is fed to tank 6 of iron body 1 via water feed portion 15 and water inlet port 7. When the water fed to tank 6 of iron body 1 reaches a predetermined level, it is detected by water level detector 9, then water feeding unit 17 is stopped by controller 18. Also, controller 18 serves to control the power to heater 5 via power feeding portion 14 and power receiving terminal 8, thereby maintaining base 4 at a predetermined temperature.

Here, iron body 1 is heated by heater 5, and the ironing surface of iron body 1 becomes nearly 200° C. in temperature. However, since water tank 16 is arranged under mount 13, the rise of surface temperature of water tank 16 is suppressed. Accordingly, water tank 16 can be attached and detached with safety. Also, since water feeding unit 17 is arranged under water tank 16, the temperature rise of water feeding unit 17 is also suppressed. Similarly, the temperature rise of power cord reel unit 27 is suppressed.

Also, mount 13 of stand 12 is slanted with the front up, and water tank 16 is disposed at the front of stand 12, and thereby, the capacity of water tank 16 can be maintained at the maximum level.

Further, as water tank 16 becomes short of water during the ironing operation, it is necessary to remove water tank 16 from stand 12 to replenish water, then the inside of water tank 16 can be seen because it is made of transparent or semi-transparent material, and it can be checked at sight when the water in water tank 16 becomes used up or lower than the specified level.

Also, when iron body 1 is placed on mount 13, at least a part of water tank 16 is positioned between base 4 of iron body 1 and power cord reel unit 27, and therefore, due to the cooling effect of water in the water tank, the temperature rise of power cord reel unit 27 due to heat of base 4 is suppressed.

When the ironing work is finished, the operator puts iron body 1 on mount 13 of stand 12. The power cord is pulled out from the power outlet and the power cord is housed in stand 12. And, cover case 19 is fitted on stand 12.

Figure 3:
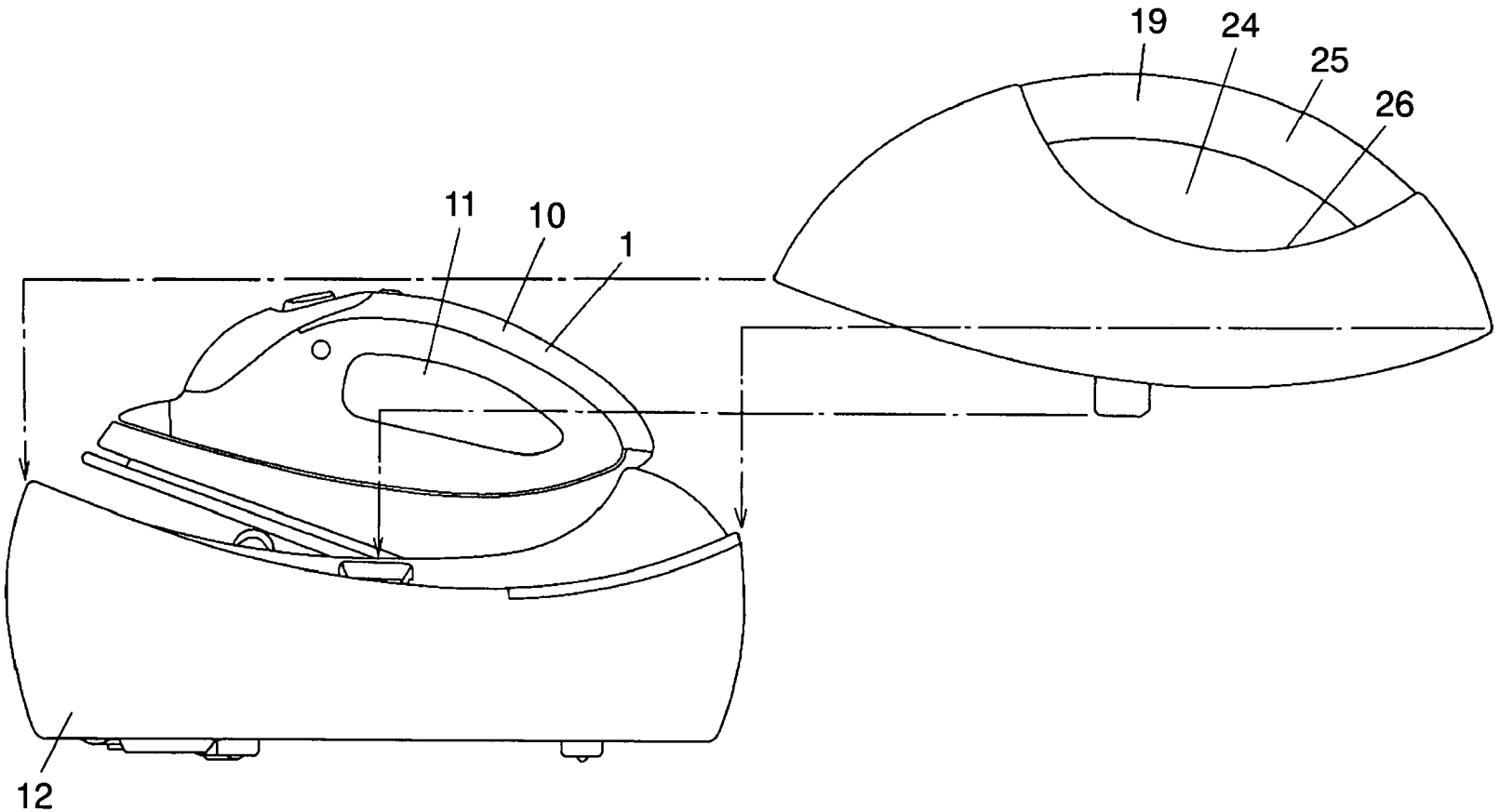
FIG. 3 is an explanatory diagram showing a state of fitting a cover case of an ironing device in the preferred embodiment.
Figure 4:
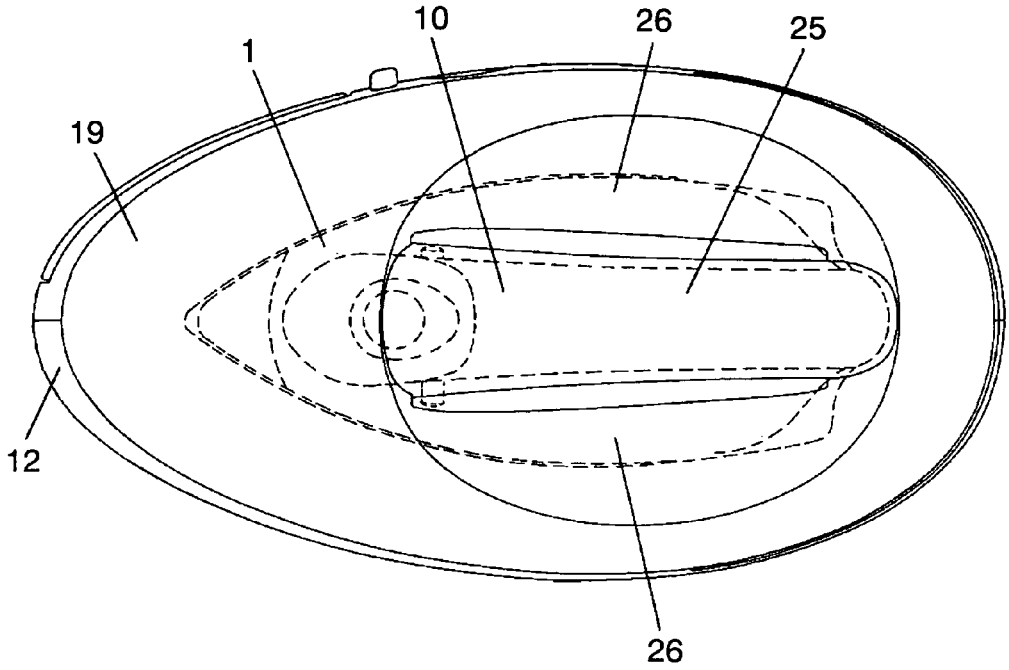
FIG. 4 is a plan view of an ironing device with a cover case fitted in place in the preferred embodiment.
Figure 5:
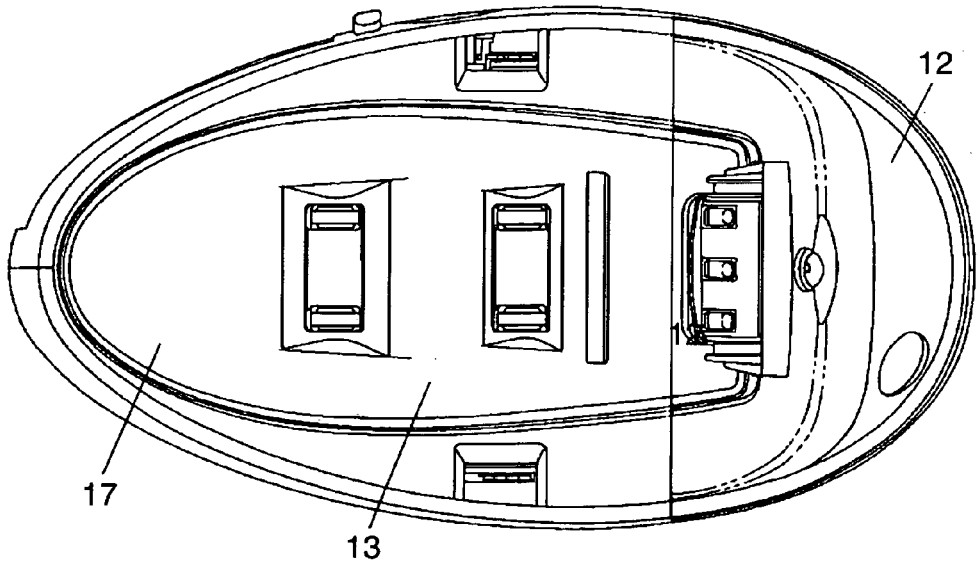
FIG. 5 is a plan view of a stand of an ironing device in the preferred embodiment.

In this case, as shown in FIG. 3, cover case 19 is put on from the back of iron body 1. At the time, the operator's eye is located obliquely above the back of cover case 19, causing the iron body to be unseen behind the cover case. However, middle portion 21 as viewed from side of cover case 19 is extended downward from its front and rear ends, and the front and rear ends are higher than middle portion 21 of the cove case. Accordingly, even when cover case 19 is put on from the forward and backward direction of iron body 1, it can be easily fitted thereon without touching the uppermost part of iron body 1 placed on mount 13.

Also, as to stand 12, middle portion 22 of the stand as viewed from side is recessed downward from its front and rear ends along the shape of bottom 20 of cover case 19. Accordingly, when cover case 19 is put on, cover case 19 is adjusted to the recessed portion of stand 12, making the positioning easier between cover case 19 and stand 12, and thereby, cover case 19 can be smoothly fitted thereon.

Further, coupling means 23 for coupling cover case 19 to stand 12 is positioned near the lowest end of cover case 19, and when cover case 19 is fitted on stand 12, coupling means 23 of cover case 19 first reaches the coupling portion of stand 12, and also, the force is concentrated on coupling means 23, and therefore, excellent fitting and coupling can be assured.

Also, as is obvious in the above description, with iron body 1 placed in position, since grip portion 10 of iron body 1 and grip portion 25 of cover case 19 can be gripped together, there is no fear of rattling of iron body 1 inside cover case 19 when the ironing device is carried. Accordingly, it can be carried in very stable condition, and there is no such problems that the mechanisms and component parts of iron body 1 and stand 12 are damaged due to shocks or the like.

Further, since the tip portion of iron body 1 is also held by holding member 29, when the ironing device is carried, there is no such fear that cover case 19 is scratched by the tip portion of base 4 or deformed due to heat of base 4, making it possible to use the ironing device in good condition for a long period of time.

It is preferable to make holding member 29 by using silicone rubber or the like which is not deformed by the heat of base 4.

Also, as shown in FIG. 6, since left-hand surface 30 and right-hand surface 31 of stand 12 are separated from each other in the configuration, peripheral joints and level differences are less as compared with the case of vertical separation, and dust is hardly deposited. For example, even when dust is deposited, it is easier to wipe off, making the area very clean at all times.

Further, since the entire bottom end of the outer shell of stand 12 is arcuately formed, even when bumped against a piece of furniture or a wall, the bumping force is easily diffused because the outer shell has no edges, and it will hardly cause damage to the ironing device, furniture or wall. Also, when cover case 19 is coupled to stand 12, the top of iron body 1 is covered by covering portion 26 formed by extending the upper surface of cover case 19 from the outer shell toward the middle thereof, and therefore, it is possible to suppress dust deposition on iron body 1 during storage.

What is claimed is:

1. An ironing device, comprising:

an iron body with a base heated by a heater;

a stand with a mount for placing the iron body thereon; and a cover case capable of being coupled to the stand, being formed with a case grip portion at an upper part thereof, wherein the case grip portion is formed by providing a case space which is provided at the upper part of the cover case and which passes through the upper part of the cover case, and wherein the case grip portion is formed with the cover case as one body.

2. The ironing device of claim 1, wherein the iron body has an iron grip portion, a body space is formed below the iron grip portion, and when the iron body places on the mount and the cover case is coupled to the stand, the case space is opposed to the body space.

3. The ironing device of claim 1, wherein when the iron body places on the mount and the cover case is coupled to the stand, the case grip portion is positioned close to the iron grip portion so as to be gripped together with the iron grip portion.

4. The ironing device of claim 1, wherein the cover case has a covering portion, the covering portion is formed below the case space, and when the cover case is coupled to the stand with the iron body placed on the mount, a covering portion covers the top of the iron body.

5. The ironing device of claim 4, wherein the covering portion is formed with an opening for protrusion of the iron grip portion.

6. The ironing device as in one of claims 1 to 5, wherein in a side view of the cover case, a middle portion thereof is extended downward from its front and back ends.

7. The ironing device of claim 6, wherein the cover case is provided with a coupling means near the lowest end thereof for coupling to the stand.

8. The ironing device as in one of claims 1 to 5, wherein the cover case is provided with a holding member at the inner front thereof for holding a tip portion of the iron body.

9. The ironing device as in one of claims 1 to 5, wherein in a side view of the stand, a middle portion of the stand is recessed downward from its front and back ends.

10. The ironing device of claim 9, wherein the stand is configured in that an outer shell thereof can be separated into right and left parts.

11. The ironing device of claim 5, wherein a lower end periphery of an outer shell of the stand is arcuately shaped.

12. The ironing device as in one of claims 1 to 5, wherein the iron body further comprises:

a vaporizing chamber formed in the base;

an iron body tank for storing water supplied to the vaporizing chamber;

a water inlet port communicated with the iron body tank; and an power receiving terminal electrically connected to the heater;

wherein the stand further comprises:

a water feed portion connected to the water inlet port when the iron body is placed on the mount;

a water tank for storing water supplied to the iron body tank;

a pump device for delivering water in the water tank to the water feed portion; and a power feeding portion having an electrode electrically connected to the power receiving terminal when the iron body is placed on the mount; and wherein the water tank is positioned below the mount.

13. The ironing device of claim 12, wherein the mount is slanted with its front up for placing the iron body thereon; and wherein the water tank is disposed at front of the stand.

14. The ironing device of claim 12, wherein the water tank is made of transparent or semi-transparent material, and the inside thereof can be seen.

15. The ironing device of claim 13, wherein the water tank is made of transparent or semi-transparent material, and the inside thereof can be seen.

16. The ironing device of claim 12, wherein the stand further comprises a power cord reel unit therein; and wherein at least a part of the water tank is positioned between the base of the iron body placed on the mount and the power cord reel unit.

17. The ironing device of claim 13, wherein the stand further comprises a power cord reel unit therein; and wherein at least a part of the water tank is positioned between the base of the iron body placed on the mount and the power cord reel unit.

* * * * *